United States Patent [19]

Koike et al.

[11] Patent Number: 4,734,615

[45] Date of Patent: Mar. 29, 1988

[54] COLOR CATHODE RAY TUBE

[75] Inventors: Norio Koike; Hidemi Matsuda; Kiyoshi Tokita; Kaneharu Kida, all of Fukaya, Japan

[73] Assignee: Kabushiki Kaisha Toshiba, Kawasaki, Japan

[21] Appl. No.: 884,615

[22] Filed: Jul. 11, 1986

[30] Foreign Application Priority Data

Jul. 17, 1985 [JP] Japan ..... 60-155981

[51] Int. Cl.[4] ..... H01J 29/07

[52] U.S. Cl. ..... 313/402; 313/407

[58] Field of Search ..... 313/402, 407; 445/47

[56] References Cited

U.S. PATENT DOCUMENTS 3,760,214 9/1973 Yamazaki et al. ..... 313/402

4,558,252 12/1985 Kanto et al. ..... 313/402

*Primary Examiner*—David K. Moore

*Assistant Examiner*—Sandra L. O'Shea

*Attorney, Agent, or Firm*—Oblon, Fisher, Spivak, McClelland & Maier

[57] ABSTRACT

The shadow mask of a color cathode ray tube is arranged in the vicinity of a phosphor screen. The shadow mask is provided with through-holes that select the electron beams emitted from the electron guns. A layer comprising, as a filler, one or other of a metal, metal oxide, metal carbide, metal nutride, or a mixture of two or more of these, for example zirconium powder and, as a binder, one of an amorphous metal oxide compound, amorphous metal hydroxide compound or a mixture of these, for example silicon oxide, is formed on the surface of the shadow mask. This layer increases thermal radiation of the shadow mask, reduces electron scattering, and raises the residual emissivity.

7 Claims, 7 Drawing Figures

COLOR CATHODE RAY TUBE

BACKGROUND OF THE INVENTION

1. Field of the Invention

This invention relates to shadow mask type color cathode ray tubes, and, more particularly, to the shadow mask.

2. Discussion of Background

In general, a shadow mask type color cathode ray tube comprises an electron gun in the tube emitting three electron beams, a shadow mask distributing these beams selectively by color, and a phosphor screen emitting light in the three colors, red, green and blue, on excitation by these beams. The image formed on the screen is observed through an envelope panel. In the shadow mask there are provided a large number of apertures which correspond precisely with the phosphor pattern of the respective color on the screen. As the effective electron beams passing through these apertures during color cathode ray tube operation represent somewhat less than a third of the incoming beams, the rest of the electrons impinge on the shadow mask and their energy is converted into heat energy, raising the temperature of the shadow mask. In a normal operating television set, the shadow mask is thereby heated to a temperature of about 80° C. In the special color cathode ray tubes used in the instrument panels in aircraft cockpits, the shadow mask temperature can rise to around 200° C. Most shadow masks consist of a lamina 0.1 to 0.3 mm thick, made by cold rolling, of which the main constituent is iron of thermal expansion coefficient $1.2\times10^{-5}$/°C. The rigid L section mask frame that supports the shadow mask skirt is about 1 mm thick, is likewise made by cold rolling, and is subjected to blackening treatment. Thermal expansion readily occurs when the shadow mask is heated. Since the shadow mask periphery is adjacent to the blackened mask frame, which has a large heat capacity, heat is transferred from the shadow mask periphery to this mask frame by radiation or conduction. This results in the temperature of the shadow mask periphery falling below the temperature at its center, producing a temperature difference between the center and periphery. This produces the "doming" phenomenon caused by relative thermal expansion taking place principally at the center. Consequently the distance between the shadow mask and phosphor screen alters, disturbing the accurate landing of the electron beams and thus impairing color purity. This phenomenon of mislanding due to doming is particularly evident when the color cathode ray tube has just been switched on. Also, if part of the picture is locally of high luminance and especially if such high luminance portions are stationary for some time, high electron flow density regions occur on the shadow mask, causing local doming.

With regard to this doming phenomenon in color cathode ray tubes, there have been a number of proposals aimed at promoting dispersal of heat from the center of the shadow mask. For instance, in U.S. Pat. No. 2826538 (Hunter et al.), it is proposed to facilitate shadow mask heat dispersal by providing a black layer of graphite on the shadow mask surface. Such a graphite layer in the color cathode ray tube acts as an excellent radiator, lowering the shadow mask temperature. However, such a black graphite layer has the following drawbacks. The thermal cycle of the heating process involved in the manufacture of the color cathode ray tube impairs the adhesion of the black layer so that when the color cathode ray tube is subjected to vibration, part of this layer separates and minute flakes fall off. When this happens, flakes adhering to the shadow mask cause blockage of the electron apertures, adversely affecting the characteristics of the image on the phosphor screen. Flakes adhering to the electron gun cause sparks between the electrodes, impairing the withstand voltage characteristic, and so forth, so that the quality of the color cathode ray tube is markedly reduced.

It has been proposed, in Japanese Patent Application No. 58-148843 (Disclosure No. 60-54139), to control doming by using high temperature heat treatment to seal lead borate glass to the surface of the shadow mask. However, since this glass layer, which is bonded to the surface of the shadow mask, contains a great deal of lead (which has a very high atomic number), it is difficult to reduce the elastic reflection of the electrons impinging on the shadow mask. In Japanese Patent Publication No. 49-14777, a proposal was made to prevent such electron scattering by nickel plating the vicinity of the mask apertures. However, the method of manufacture is not practical because it is too complicated, and electron scattering by the surface of the shadow mask apart from the apertures cannot be altogether eliminated. Electron scattering causes emission of light from undesired parts of the screen, spoiling image contrast, and lowering color purity.

SUMMARY OF THE INVENTION

It is an object of this invention to provide a color cathode ray tube of improved picture contrast and purity drift characteristics by decreasing elastic reflection of the electron beams at the shadow mask surface and controlling expansion resulting from shadow mask heat evolution produced by the electron beams.

According to this invention, in a color cathode ray tube equipped with: a phosphor screen; a shadow mask adjacent this screen and provided with a large number of through-holes or apertures: and an electron gun arranged on the opposite side of the shadow mask to said phosphor screen; wherein the electron beam emitted from the electron gun pass through the through-holes of the shadow mask to impinge on the screen; in at least a part of the shadow mask surface, a layer is formed that includes one substance selected from the group consisting of: metal, metal oxide, metal carbide, metal nitride and mixture thereof; using as a binder a substance selected from the group consisting of: amorphous metal oxide, amorphous metal hydroxide and mixture thereof. This layer on the shadow mask is obtained by applying, to the surface of the shadow mask provided with a large number of holes, a suspension containing a metal alkoxide compound, then subjecting the shadow mask to heat treatment.

Any desired alkoxide, such as a methoxide $M(OCH_3)_n$ (where M means a metal), ethoxide $M(OC_2H_5)_n$, n-propoxide $M(O.n—C_3H_7)_n$, or isopropoxide $M(O.iso—C_3H_7)_n$, buthoxide $M(O.n—C_4H_9)_n$, or isobuthoxide $M(O.iso—C_4H_9)_n$ may be used. Those which are readily soluble at ordinary temperature in water-soluble low alcohols such as methanol, ethanol, or propanol are easiest to handle industrially.

According to this invention, the rise in temperature of the shadow mask is limited since the thermal radiation coefficient of this layer is high, so heat can easily escape. Since the volume resistivity of the layer is large, when a large current flows, the layer absorbs electrons and acquires a negative charge, which applies an electrostatic correction to the beam. Furthermore, electron scattering is reduced because the atomic number of the metal contained in the layer is low. Additionally this layer increases the residual emission either by gas adsorption or by suppressing gas generation, since it is finely formed on the shadow mask.

PREFERRED EMBODIMENT OF THE INVENTION

Figure 1:
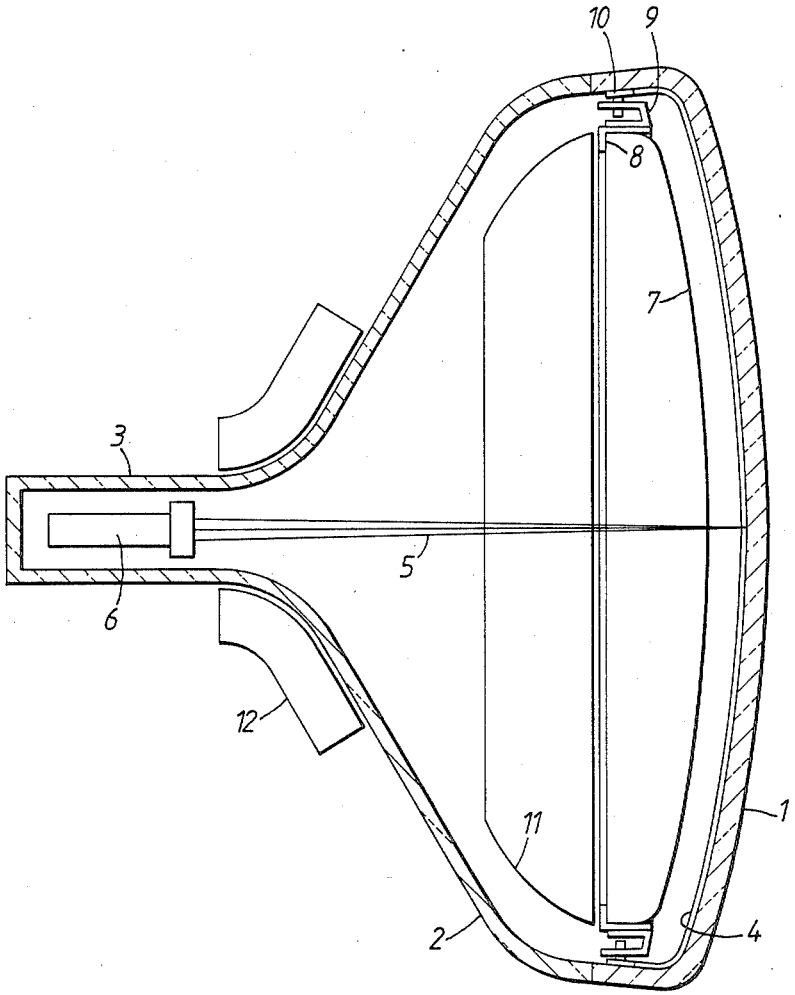
FIG. 1 is an axial cross-sectional view of an embodiment of this invention.

The invention is described in detail below with reference to embodiments. As shown in FIG. 1, the shadow mask type color cathode ray tube of this embodiment is provided with an evacuated envelope consisting of an essentially rectangular panel 1, a funnel 2 and a neck 3. The inside of panel 1 is coated wth a phosphor screen 4 formed by a phosphor layer in the form of stripes that emit respectively red, green and blue light. In-line electron guns 6 that emit three electron beams corresponding to red, green and blue are arranged in neck 3 in line along the horizontal axis of panel 1. A shadow mask 7, wherein a large number of slot-shaped apertures are arranged in the vertical direction and a large number of vertical rows thereby are provided in the horizontal direction, is fixedly supported by a mask frame 8 at a position adjacent to and opposite phosphor screen 4. Mask frame 8 is supported within the panel by means of stud pins 10 embedded in the inside wall of the vertical edge of panel 1 by means of resilient members 9.

The three in-line electron beams 5 are deflected by a deflecting device 12 provided outside funnel 2 so that they are scanned over a rectangular area corresponding to rectangular panel 1. The color picture is reproduced by color-selecting these beams landing on the phosphor stripe layer through the apertures of shadow mask 7. In some cases, the electron beams may not land accurately on the phosphor stripes for which they are intended, due to the effect of external magnetic fields such as the earth's magnetic field. This spoils the color purity of the picture. To prevent this, a magnetic shield 11 of high permeability, made of high permeability metal sheet, is fastened to the inside of the funnel 2 by means of frame 8.

The material of the shadow mask is for example low carbon steel sheet of thickness 0.1 mm to 0.3 mm whose main constituent is iron. A photo-resist film is obtained on both sides of this shadow mask by applying and then drying a photo-sensitive liquid consisting of for example alkali milk caseinate and ammonium bichromate. Next, a negative mask provided with the prescribed hole pattern is tightly stuck onto this photo-resist film and developed by exposure, so as to expose those parts of the metal surface where the through-ormeholes are to be formed. Then through-holes having the prescribed aperture shape are formed by spraying etching liquid comprising ferric chloride onto the exposed metal surface. This shadow mask blank, in the form of a flat sheet formed with through-holes, is mounted in a prescribed outer frame. Its edges are clamped by a blank holder and die, and its main area, that is provided with the through-holes, is formed to the prescribed curved surface by a punch above and a knockout below. Its peripheral region is then bent over for example in the axial direction to provide a skirt for supporting and holding the main area of the mask. The skirt of the thus-formed shadow mask is supported and fixed in a rigid frame of for example L-shaped cross-section.

Next, a film of thickness about 15 micron is applied to one side of the main area of the shadow mask, where the through-holes are provided, by spraying a suspension of for example, as in the following Example, an alkoxide of silicon and zirconia, e.g. $Si(OC_2H_5)+Zr(OC_4H_9)_4$, containing silicon zirconate ($ZrSiO_4$) as a filler, onto the main area of the mask, which is concave towards the electron gun when it is arranged adjacent the screen. The filler is desired to be of a material containing metal component with smaller atomic number than that of lead.

EXAMPLE zircon (powder, mean particle diameter 0.7 micron) —500 gr alkoxide of silicon and zirconia—100 gr isopropyl alcohol—400 gr Various methods may be used to apply this suspension. The requirements which such methods must satisfy are that the suspension must be applied uniformly and the through-holes must not get blocked. Painting the suspension on using a brush, for example, is undesirable due to the risk of producing a non-uniform coating and blocking the holes. In this respect, with the spraying method, if the suspension is applied with a spraying pressure of about 3 $kg/cm^2$ from a distance of 20 cm to 30 cm, a film of thickness about 15 micron as in the above Example can be formed in about 10 seconds. This is the preferred method for mass production since if there should be any foreign bodies stuck in the through-holes, they will be removed by the high pressure suspension liquid hitting the back of the mask.

Figure 2:
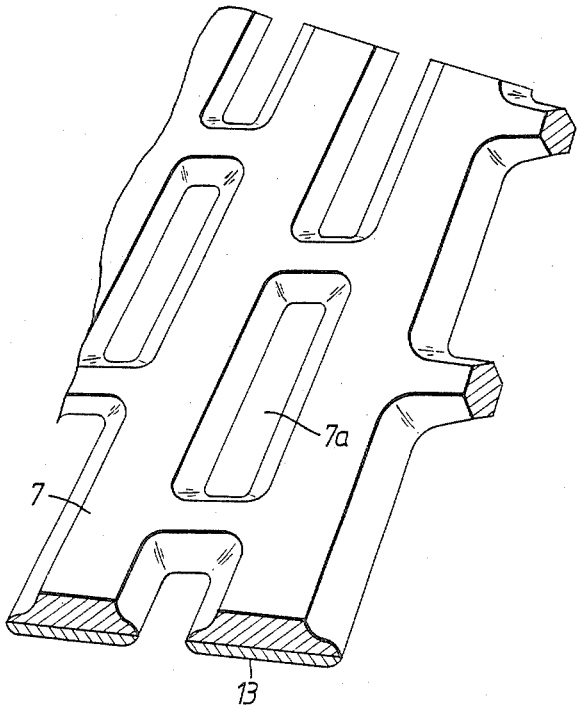
FIG. 2 is an enlarged perspective view showing part of the shadow mask of this embodiment in FIG. 1.

Thus a layer 13 as shown in FIG. 2 can be obtained by heating, in an atmosphere at 70° C. or above, a shadow mask coated, on the surface facing the electron guns, with a suspension of an alkoxide compound of silicon and zirconia, containing zircon as a filler. The alkoxide compound of silicon and zirconia applied to shadow mask 7 undergoes hydrolysis due to the moisture in the air etc. in an atmosphere at 70° C. or over, resulting in the formation of a film by a polycondensation reaction between the alkoxides, forming a zircon-containing mixed layer of amorphous silicon and zirconia metal oxides and metal hydroxides. Although in the above example, the suspension was heated after application, to shorten the manufacturing time, if the suspension is applied while heating to 70° C. or more, the subsequent heat treatment step can be dispensed with.

Also, since the alkoxide compound of silicon and zirconia has a good radiation absorption characteristic in the infra-red region, it has been found that satisfactory film formation can be achieved even at ordinary temperatures, without using an atmosphere of over 70° C., by irradiating the surface of the shadow mask with for example infra-red radiation whilst the suspension containing the alkoxide compound of silicon and zirconia is being applied. It is also possible to irradiate with infra-red radiation after applying the suspension.

Once thus-completed shadow mask 7 has been assembled with the panel, the screen forming step is carried out. First of all, an azide photo-resist film is formed on the inside face of the panel, and exposed through through-holes *7a* of shadow mask 7 using an ultra-high pressure mercury lamp. After developing the resist film, the graphite is applied and dried, developed using a decomposing agent, and narrow light-absorbing strips formed at prescribed positions on the inside face of the panel. Next, phosphor particles, in the form for example of a slurry to which phosphor particles for blue have been added, are applied on the inside face of the panel, onto a photoresist film consisting of ammonium dichromate and polyvinyl alcohol. Exposure and developing are then performed as above to form blue-emitting phosphor strips. Green-emitting and red-emitting phosphor strips are then successively formed in the same way to obtain the screen.

When the panel has been completed by the above steps, it is bonded to the funnel using frit glass and, after exhausting and sealing, the prescribed steps are performed to obtain the color cathode ray tube.

Figure 3:
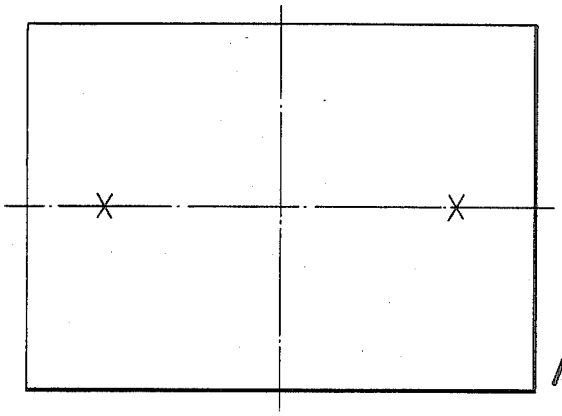
FIG. 3 and FIG. 4 are schematic illustrations of the reproduced picture pattern, given in explanation of the purity drift characteristics of this embodiment of the invention.
Figure 4:
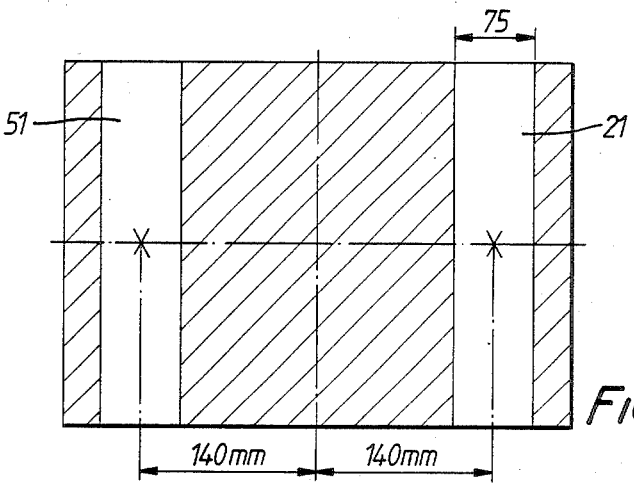

The purity drift characteristics obtained by the inventors for 21 inch color cathode ray tubes manufactured as above were as follows. The sample screen picture patterns used for these experiments are shown in FIG. 3 and FIG. 4. The pattern of FIG. 3 is one in which the whole screen is white, while the pattern of FIG. 4 is one in which part of the screen is white. In the FIG. 4 pattern, there are two white bands 51 of horizontal width 75 mm disposed on the left and right respectively with their centers 140 mm from the center of the screen, the rest of the screen being black i.e. not emitting light. The symbol x indicates the measurement points. The results of measurement of the amount by which the beams are displaced are shown in Table 1. The measurement conditions were Eb=26.5 kV. Ik in the case of pattern (A) is 1,500 microamp, and in the case of pattern (B) is 1,100 microamp.

TABLE 1

| | Pattern (A) | Pattern (B) |
|---|---|---|
| Comparative Example | 100 | 100 |
| This invention | 90 | 95 |

Figure 7:
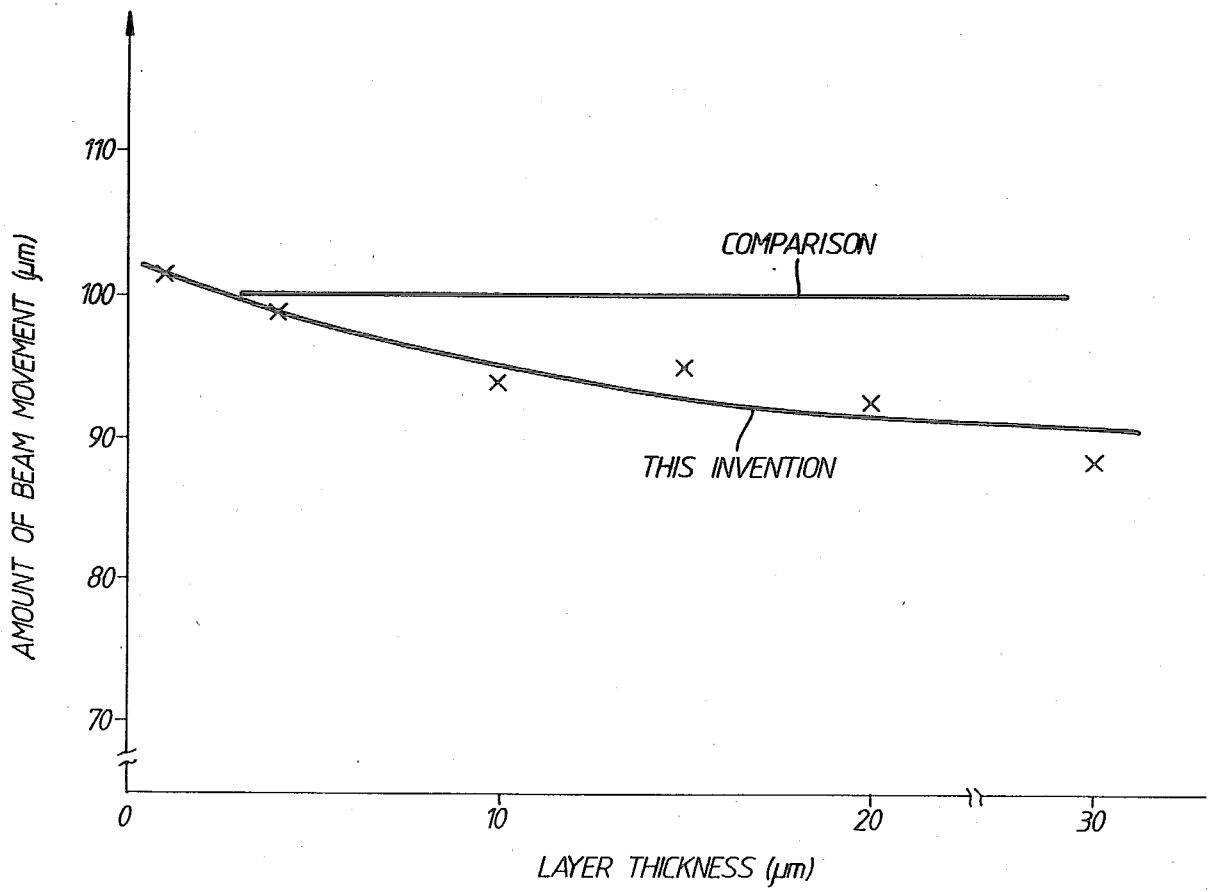
FIG. 7 is a characteristic graph showing the relationship between layer thickness and amount of beam movement for a product used for comparison, for the case of the pattern shown in FIG. 4.

The comparative examples in the above Table were provided by 21 inch color cathode ray tubes wherein, by heating at high temperature, lead borate glass was sealed and bonded in about 20 micron thickness to the surface, facing the electron guns, of shadow masks constructed as proposed in Japanese Patent Application No. 58-148843 (Patent Disclosure No. 60-54139) invented by the present inventor and others. The inventors found that the purity characteristic of color cathode ray tubes according to this invention was better than that of the prior art color cathode ray tubes. This was because the thermal emissivity (about 0.9) of the zircon-containing layer formed on the shadow mask is much greater than that of the prior art shadow mask, so radiation of heat from the shadow mask is promoted thereby limiting the rise in temperature of the shadow mask. FIG. 7 shows the improvement of the beam displacement characteristic, in comparison with the prior art, for the pattern of FIG. 4, obtained by varying the thickness of the applied layer. As can be seen from this graph, the preferred range of thickness is 1 micron to 30 micron. In this embodiment, zircon was used as the filler. However, the essence of this invention is not restricted to this, and a similar improvement in thermal emissivity and purity drift characteristic can be obtained by using dark pigments comprising other metal oxides, such as cobalt oxide, chromium oxide, iron oxide, or manganese oxide. Also carbides, such as silicon carbide, boron carbide, tungsten carbide etc. can be used as fillers with the same effect. No doubt this is because the thermal conductivity of these carbides is greater than that of the mild steel sheet, facilitating removal of heat generated in the shadow mask. Specifically, the thermal conductivity of the mild steel sheet is 0.11 cal/cm.sec°C., while that of silicon carbide is 1.0 cal/cm.sec°C., that of boron carbide is 0.65 cal/cm.sec°C., and that of tungsten carbide is 0.7 cal/cm.sec°C. Also nitrides, such as silicon nitride, boron nitride, or aluminium nitride etc. can be used as fillers with the same effect. It is believed this is because the volume resistivity of these nitrides is large ($10^{12}$ ohm-m to $10^{14}$ ohm-m), so that when a large current flows, this layer acts as an electron-absorbing layer, becoming negatively charged. As a result, it is able to exert an electrostatic correction effect on the electron beams, which improves the purity drift characteristic. A similar effect is obtained by use of tungsten, lead, or bismuth etc.

In the above embodiment the use of a compound of silicon zirconia for the metal alkoxide compound is described. However, as in the case of the filler, the essence of the invention is not restricted to this, and alkoxide compounds of for example silicon, silicon and titanium, silicon and aluminium, titanium and zirconium etc. can be used.

Figure 5:
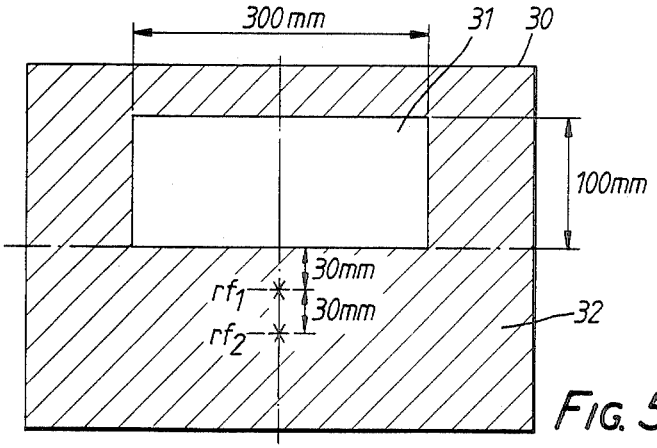
FIG. 5 is a sschematic illustration of the reproduced picture pattern, given in explanation of the contrast characteristics of this embodiment of the invention.

Next, for purposes of comparison, the contrast characteristic of a color cathode ray tube manufactured with a shadow mask according to Japanese Patent Application No. 58-148843 referred to above but otherwise similarly to the color cathode ray tube of this invention described above was obtained. For the purposes of the test, the picture pattern shown in FIG. 5 was reproduced. A white portion 31 of dimensions 300 mm×100 mm was disposed in the middle of the top of this screen 30, the remainder 32 being black. The measurement points, referred to as rf1 and rf2, are indicated by the symbol x and are located respectively 30 mm and 60 mm below the center of the screen. The luminance at these points rf1 and rf2 is shown in Table 2. The measurement conditions were that the anode voltage Eb of the color cathode ray tube was 26.5 kV, the total cathode current Ik was 500 micro-amp, and the color of the white color was 9,300° K.+27MPCD.

TABLE 2

| | rf1 | rf2 |
|---|---|---|
| Comparative Example | 100 | 100 |
| Embodiment | 75 | 70 |

It can be seen from Table 2 that the luminance of the dark portion is reduced in this embodiment of the invention. This means that the elastic scattering of electrons is decreased. This is dependent on the atomic numbers of the Si and Zr constituents of coating layer 13 (their atomic numbers are 14 and 40 respectively) being lower than the atomic numbers 82 and 56 of the Pb and Ba of the lead borate glass of the comparison product.

The residual emission percentage after subjecting a color cathode ray tube according to this embodiment to a 3,000 hours continuous operation test was then determined. It was found that the residual emission percentage was indeed improved, being 80% of the initial value. For the prior art product, a residual emission percentage of 70% is standard. Thus this represents an improvement of better than 10%. This is inferred to be because of gas adsorption by the coating layer of this embodiment. The amorphos silicon oxide ($SiO_2$) that is used as a binder appears to be particularly effective in this respect.

Figure 6:
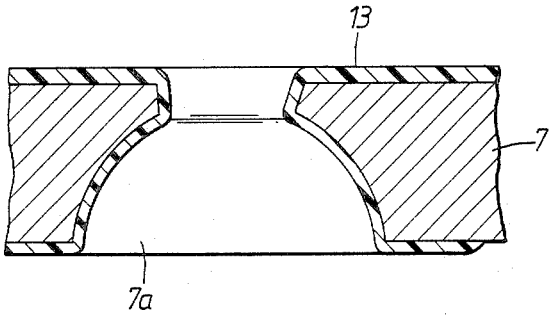
FIG. 6 is a partial cross-sectional view showing another embodiment of this invention.

Also it is thought that generation of gas is suppressed by the formation of a fine coating layer on the shadow mask surface. It is therefore particularly effective to form the coating on the surface of the shadow mask facing the electron guns, since this surface reaches a very high temperature when the electron beams impinge on it and so tends to generate unstable gases. Of course, formation of such a coating increases the manufacturing process, but, as shown in FIG. 6, if the whole of the shadow mask surface is covered by coating 13 according to this invention, practically all generation of unstable gases by the shadow mask can of course be suppressed.

In the description of this embodiment, the suspension containing an alkoxide compound of zircon and silicon and zirconia was applied to the shadow mask before forming the phosphor screen, and a mixed zircon-containing layer of silicon and zirconia amorphous metal oxides and metal hydroxides was formed. However, if the presence of this coating layer causes a slight adverse photochemical effect in the exposure step when forming the phosphor screen, the formation of this coating can be carried out after formation of the phosphor screen.

If the coating of this invention is formed on the surface of the shadow mask facing electron guns, it is not necessary to form a conductive coating. By this means, a 5 to 10% improvement in the purity drift characteristic can be obtained compared with the case where a conductive coating is formed.

As described above, according to this invention, a color cathode ray tube can be obtained with improved contrast and purity drift characteristics, a better emission life characteristic, and which is well adapted for mass production.

We claim:

1. A color cathode ray tube comprising:

a phosphor screen;

a shadow mask with a large number of apertures, arranged in the vicinity of said phosphor screen;

an electron gun generating an electron beam passing through said apertures of said shadow mask to excite said phosphor screen;

wherein said shadow mask is coated with a layer consisting essentially of a binder selected from the group consisting of amorphous metal oxide, amorphous metal hydroxide and mixture thereof; and a filler selected from the group consisting of metal, metal oxide, metal carbide, metal nitride and mixture thereof.

2. The color cathode ray tube according to claim 1 wherein said layer is formed on a surface of said shadow mask facing said electron gun.

3. The color cathode ray tube according to claim 1 wherein said binder is a product of heat treatment of a metal alkoxide compound.

4. The color cathode ray tube according to claim 3 wherein metal of said metal alkoxide compound is one selected from the group consisting of silicon, titanium, aluminum, zirconium and mixture thereof.

5. The color cathode ray tube according to claim 1 wherein said filler is one selected from the group consisting of silicon carbide, manganese oxide, chromium oxide, iron oxide, cobalt oxide, copper oxide, zircon, zirconium and mixture thereof.

6. The color cathode ray tube according to claim 1 wherein the thickness of said layer is 1 micron to 30 micron.

7. The color cathode ray tube according to claim 1 wherein the filler is dark in color.

* * * * *